US005878706A

United States Patent [19]

Akamatsu

[11] Patent Number: 5,878,706

[45] Date of Patent: Mar. 9, 1999

[54] PLUG CAP FOR IGNITION PLUG

[75] Inventor: Kunihiko Akamatsu, Shizuoka, Japan

[73] Assignee: Yazaki Corporation, Tokyo, Japan

[21] Appl. No.: 956,789

[22] Filed: Oct. 23, 1997

[30] Foreign Application Priority Data

Oct. 25, 1996 [JP] Japan ..... 8-284061

[51] Int. Cl.[6] ..... H01T 13/06

[52] U.S. Cl. ..... 123/143 C; 123/169 PA; 439/125

[58] Field of Search ..... 123/143 C, 169 PA, 123/169 PH; 439/125–128, 206

[56] References Cited

U.S. PATENT DOCUMENTS

| | | | |
|---|---|---|---|
| 4,637,358 | 1/1987 | Yano et al. | 123/169 PH X |
| 5,377,640 | 1/1995 | Kobayashi | 123/143 C |
| 5,462,023 | 10/1995 | Furuya | 123/143 C |
| 5,549,082 | 8/1996 | Kobayashi | 123/143 C |
| 5,592,911 | 1/1997 | Komatsu | 123/143 C |
| 5,618,193 | 4/1997 | Nakajima et al. | 123/169 PA X |
| 5,628,298 | 5/1997 | Murata | 123/143 C X |
| 5,662,095 | 9/1997 | Matsuo | 123/143 C |

FOREIGN PATENT DOCUMENTS

| | | |
|---|---|---|
| 63-35268 | 3/1988 | Japan . |
| 4-81490 | 7/1992 | Japan . |
| 5-59786 | 8/1993 | Japan . |
| 6-19295 | 3/1994 | Japan . |

*Primary Examiner*—Tony M. Argenbright
*Attorney, Agent, or Firm*—Sughrue, Mion, Zinn, Macpeak & Seas, PLLC

[57] ABSTRACT

A plug cap 100 for an ignition plug includes a first annular seal member 30 which seals a gap between an ignition cable 4 and an inner surface of an insulating pipe 20 in a liquid-tight manner and a second annular seal member 24 which seals a gap between an inner surface of an ignition plug-mounting hole 2 and an outer surface of the insulating pipe 20 in a liquid-tight manner. A cap member 40 includes a cover portion 41 which covers those portions of the first and second seal members exposed to the exterior of the engine, and an ignition cable-holding portion 43 which holds and curves the ignition cable 4 to regulate the angle of extension of the ignition cable 4 from the insulating pipe 20.

6 Claims, 6 Drawing Sheets

PLUG CAP FOR IGNITION PLUG

BACKGROUND OF THE INVENTION

1. Field of the Invention

This invention relates to a plug cap for an ignition plug which is used for connecting an ignition cable to an ignition plug in an engine, for example, of an automobile, and more particularly to an improved ignition plug cap in which the provision of a rain cover for preventing rain water from intruding into an ignition plug-mounting hole and an insulating pipe is omitted, thereby reducing a manufacturing cost, and also enhancing an assembling efficiency, and besides a variation in the angle of extending of the ignition cable from the insulating pipe can be prevented.

2. Related Art

A plug cap has heretofore been used for connecting an ignition cable to an ignition plug in an engine. One example of such ignition plug cap will be described with reference to FIG. 8. An ignition plug 3 is mounted in a bottom of an ignition plug-mounting hole 2 formed in an engine head 1. A plug cap 5 is used to connect an ignition cable 4 (which supplies a high-voltage current) to the ignition plug 3.

The plug cap 5 includes a narrow, elongate insulating pipe 6 inserted in the ignition plug-mounting hole 2, the insulating pipe 6 being molded of an insulative resin material. A front end portion of the ignition cable 4, as well as a connection terminal 7 for connecting the ignition cable 4 to an end metal member of the ignition plug 3, is received within the insulating pipe 6. An end cap 8, molded of an insulative rubber material, is attached to a lower end of the insulating pipe 6, and this end cap 8 is fitted on an insulator portion of the ignition plug 3 so as to prevent the leakage of a high-voltage current.

A rain cover 10 for preventing rain water from intruding into the insulating pipe 6 is attached to an upper end of the insulating pipe 6. A flange 12 and an intimate-contact portion 13 of a generally cylindrical shape are molded integrally with a cylindrical body portion 11 of the rain cover 10 fitted on the insulating pipe 6. The flange 12 is held in intimate contact with the surface of the engine head 1 to cover an open portion of the ignition plug-mounting hole 2, and the intimate-contact portion 13 is intimately fitted on the ignition cable 4.

Vent holes 14 and 15, which communicate a space in the ignition plug-mounting hole 2 with the exterior of the engine, are formed respectively in the insulating pipe 6 and the rain cover 10, and extend parallel to the axis of the insulating pipe 6. The vent hole 15, formed in the rain cover 6, is open to a distal end of a conical rainproof portion 16 formed upright on an upper surface of the rain cover 10.

The rain cover 10 for the ignition plug cap 5 tends to become large in size because of its construction. And besides, the rain cover 10 must maintain an insulating effect and a liquid-tight seal for a long period of time while withstanding heat and vibrations produced by the engine, and therefore a relatively expensive rubber material is used to form the rain cover 10, thus inviting the problem that this cost is high.

The ignition cable 4 must be installed along the surface of the engine head 1 so that it will not interfere with other parts provided around the engine. However, a conductor of the ignition cable 4 is thick so as to suppress a voltage drop to a minimum when supplying a high-voltage current, and besides the ignition cable 4 has a shield mesh wire so as to prevent radio noises from leaking to the exterior, and therefore the ignition cable 4 is complicated in construction, and has high flexural rigidity. Therefore, the rain cover 10, which is made of rubber, and hence has low rigidity, can not accurately regulate the angle of extending of the ignition cable 4 from the insulating pipe 6, so that there occurs a variation in the position of installation of the ignition cable 4.

Furthermore, when the rain cover 10 is fitted on the insulating pipe 6, the rain cover 10 is deformed, and therefore there is a fear that the vent hole 15 is crushed, thus adversely affecting the ventilation. If a droplet exists at the distal end of the rainproof portion 16, this droplet is often drawn into the ignition plug-mounting hole 2 by a breathing action of the ignition plug-mounting hole 2 caused by the heating and cooling of the engine, and in some cases this invites the leakage of the high-voltage current and a combustion failure.

There is a further problem that the efficiency of mounting of the ignition cable 4 on the rain cover 10 and the efficiency of mounting of the rain cover 10 on the insulating pipe 6 are low.

SUMMARY OF THE INVENTION

It is an object of this invention to overcome the above problems, and more specifically to provide a plug cap for an ignition plug in which the cost of parts is reduced, and an assembling efficiency is enhanced, and the interior of an ignition plug-mounting hole is positively kept in communication with the exterior of an engine, and the angle of extending of an ignition cable from an insulating pipe can be positively regulated.

In order to solve the above problems, according to the present invention, there is provided a plug cap for an ignition plug comprising an insulating pipe which is molded of an insulative resin material, and is inserted in an ignition plug-mounting hole formed in an engine head; an ignition cable inserted in the insulating pipe so as to supply a high-voltage current to the ignition plug provided in the ignition plug-mounting hole; a first annular seal member which is fitted in one open end of the insulating pipe remote from the ignition plug, and seals a gap between the ignition cable and an inner surface of the insulating pipe in a liquid-tight manner; a second annular seal member which is fitted on the insulating pipe, and seals a gap between an inner surface of the ignition plug-mounting hole and an outer surface of the insulating pipe in a liquid-tight manner; and a cap member of a resin fixed to the insulating pipe, the cap member including a cover portion which covers those portions of the first and second seal members exposed to the exterior of the engine, and an ignition cable-holding portion which holds and curves the ignition cable to thereby regulate the angle of extension of the ignition cable from the insulating pipe; wherein a vent hole, which communicates a space in the ignition plug-mounting hole with the exterior of the engine, is formed in the insulating pipe.

Therefore, the gap between the ignition cable and the inner surface of the insulating pipe is sealed liquid-tight by the first annular seal member, and also the gap between the inner surface of the ignition plug-mounting hole and the outer surface of the insulating pipe is sealed liquid-tight by the second annular seal member, and with this construction the cost of the parts can be made relatively low. Since the ignition cable is merely passed through the first seal member, the assembling efficiency can be enhanced.

Since the cover portion of the cap member covers those portions of the first and second seal members exposed to the exterior of the engine, water is prevented from being applied directly to the first and second seal members, and therefore the intrusion of water into the ignition plug-mounting hole can be positively prevented.

The vent hole, which communicates the space in the ignition plug-mounting hole with the exterior of the engine, is formed in the insulating pipe, and therefore the vent hole will not be deformed when mounting the insulating pipe into the ignition plug-mounting hole, and the space in the ignition plug-mounting hole can be positively communicated with the exterior.

The ignition c able is held and curved by the ignition cable-holding portion of the cap member (made of a high-rigidity resin) fixed to the insulating pipe, and therefore the angle o f extension of the ignition cable from the insulating pipe can be positively regulated.

The vent hole is open to the inside of the cover portion of the cap member. Therefore, water will not be applied directly to the opening of the vent hole, and the intrusion of water into the ignition plug-mounting hole via the vent hole is positively prevented.

The vent hole has the extension portion formed in the area of contact between the insulating pipe and the first seal member. Therefore, even if water intrudes into the opening of the vent hole, the water is prevented from being introduced into the ignition plug-mounting hole via the vent hole.

The vertical wall for preventing the intrusion of water into the opening, of the vent hole is formed on the inner surface of the cover portion of the cap member in opposed relation to this opening. Therefore, water is more positively prevented from being applied directly to the opening of the vent hole.

The opening of the vent hole has the slanting surface such that the opening is increasing in cross-sectional area progressively toward its distal end, so that a droplet, intruded into the opening, can flow downward along this slanting surface to be discharged to the exterior of the opening. Therefore, even if a droplet intrudes into the opening, this droplet flows along the slanting surface, and is discharged to the exterior of the opening, and thus will not intrude into the inner portion of the vent hole. Even if a droplet is deposited on the slanting surface, the ignition plug-mounting hole can be ventilated through a gap above this droplet, and therefore the droplet will not be drawn into the vent hole by a breathing action of the ignition plug-mounting hole.

The cap member has the notch portion for receiving the ignition cable. Therefore, the cap member can be easily attached to the ignition cable and the insulating pipe.

DETAILED DESCRIPTION OF THE PREFERRED EMBODIMENTS

Figure 1:
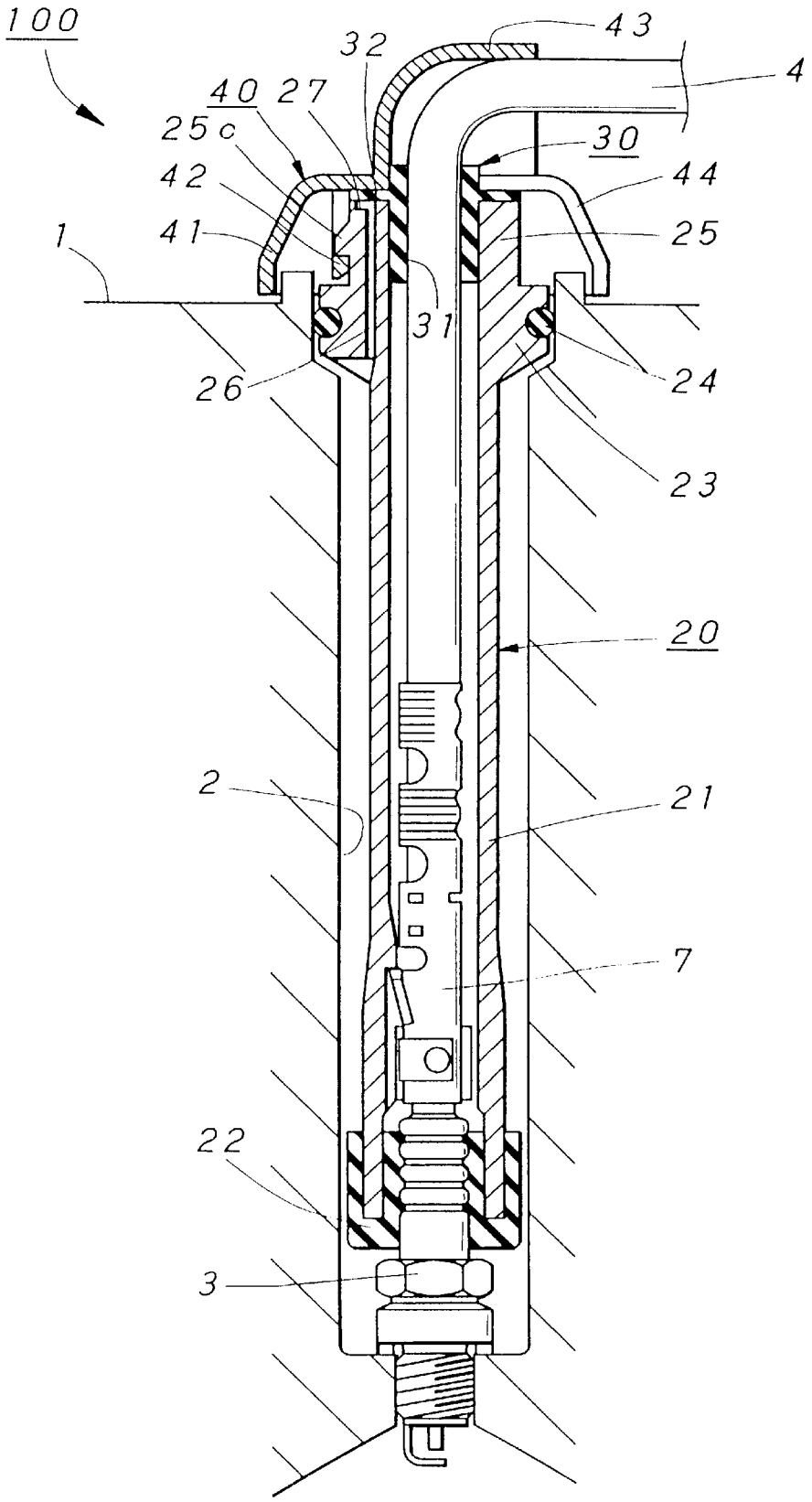
FIG. 1 a vertical cross-sectional view showing the whole of a plug cap for an ignition plug provided in accordance with one embodiment of the present invention.
Figure 4:
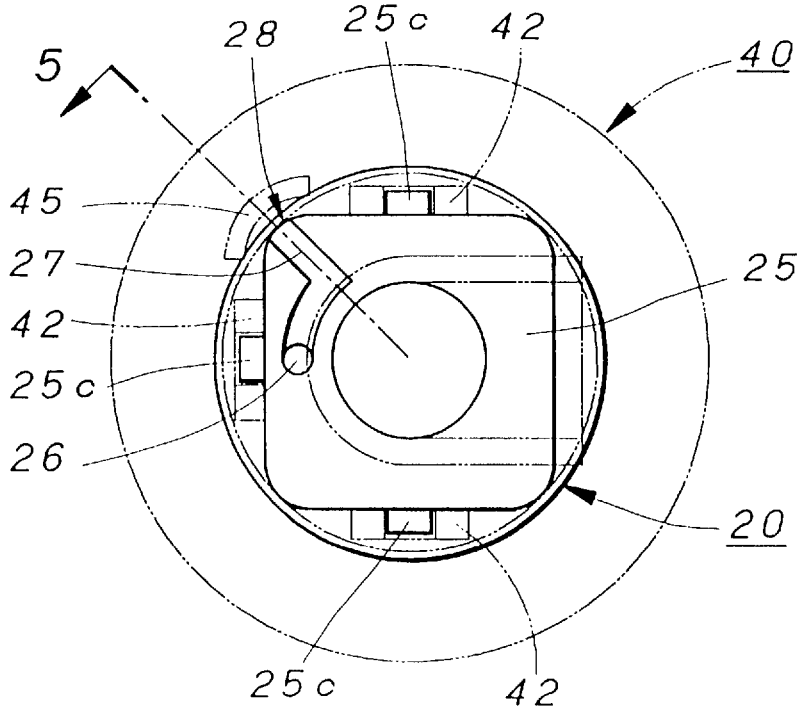
FIG. 4 is a plan view showing an upper end surface of an insulating pipe of FIG. 3 on an enlarged scale.
Figure 5:
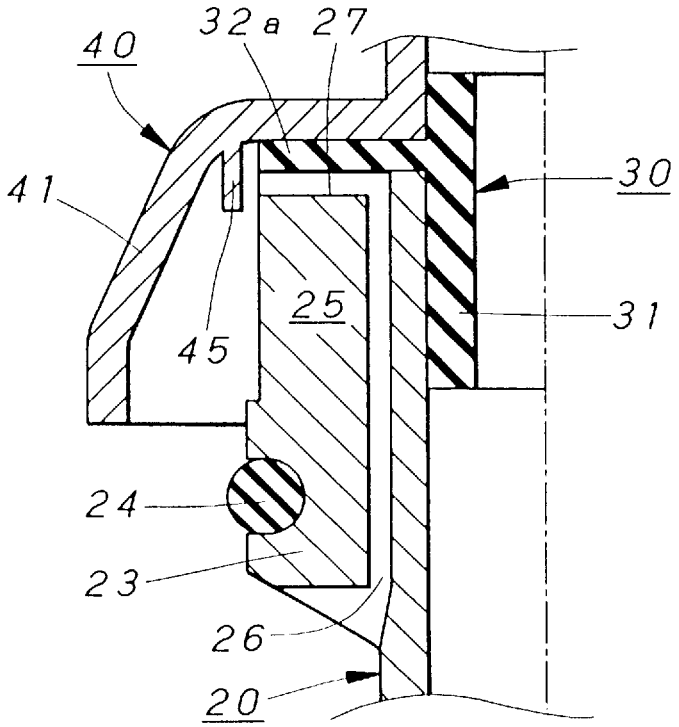
FIG. 5 is a vertical cross-sectional view taken along the line 5 of FIG. 4.
Figure 6:
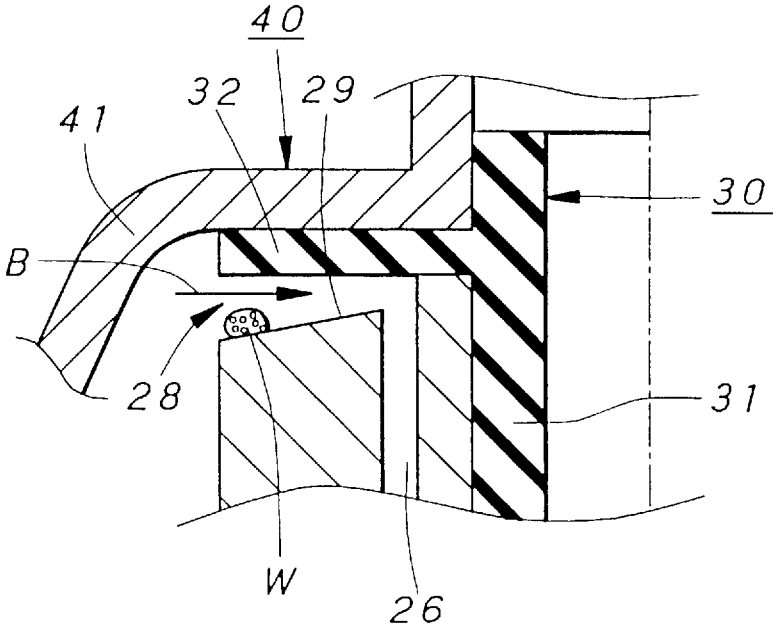
FIG. 6 is an enlarged, vertical cross-sectional view showing an opening of a vent hole having a slanting surface.
Figure 7:
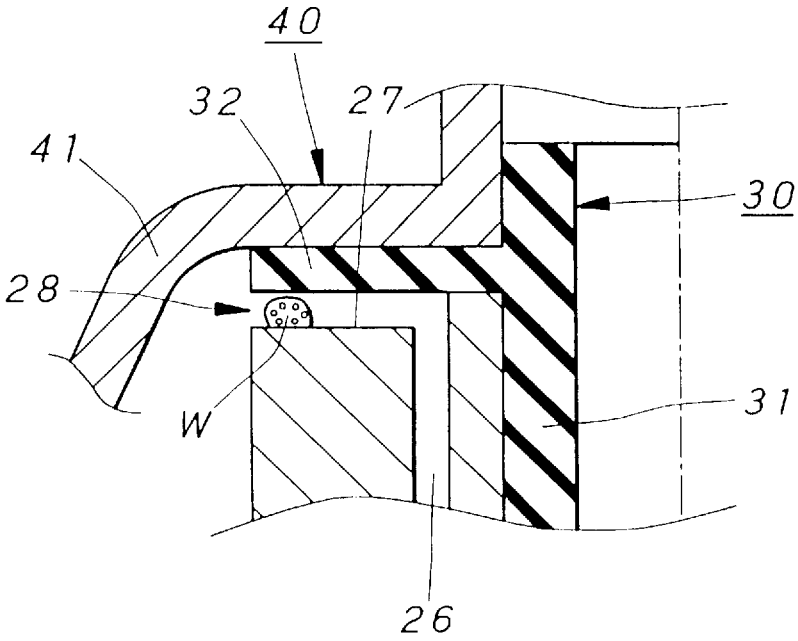
FIG. 7 is an enlarged, vertical cross-sectional view showing the opening of the vent hole having no slanting surface.

One preferred embodiment of a plug cap of the invention for an ignition plug will now be described in detail with reference to FIGS. 1 to 7. FIG. 1 a vertical cross-sectional view showing the whole of the ignition plug cap of the invention, FIG. 2 is an enlarged cross-sectional view of an important portion in FIG. 1, FIG. 3 is an exploded, perspective view showing main constituent parts in FIG. 1, FIG. 4 is a plan view showing an upper end surface of an insulating pipe of FIG. 3 on an enlarged scale, FIG. 5 is a vertical cross-sectional view taken along the line A of FIG. 4, and FIGS. 6 and 7 are vertical cross-sectional views showing an opening of a vent hole on an enlarged scale.

Figure 2:
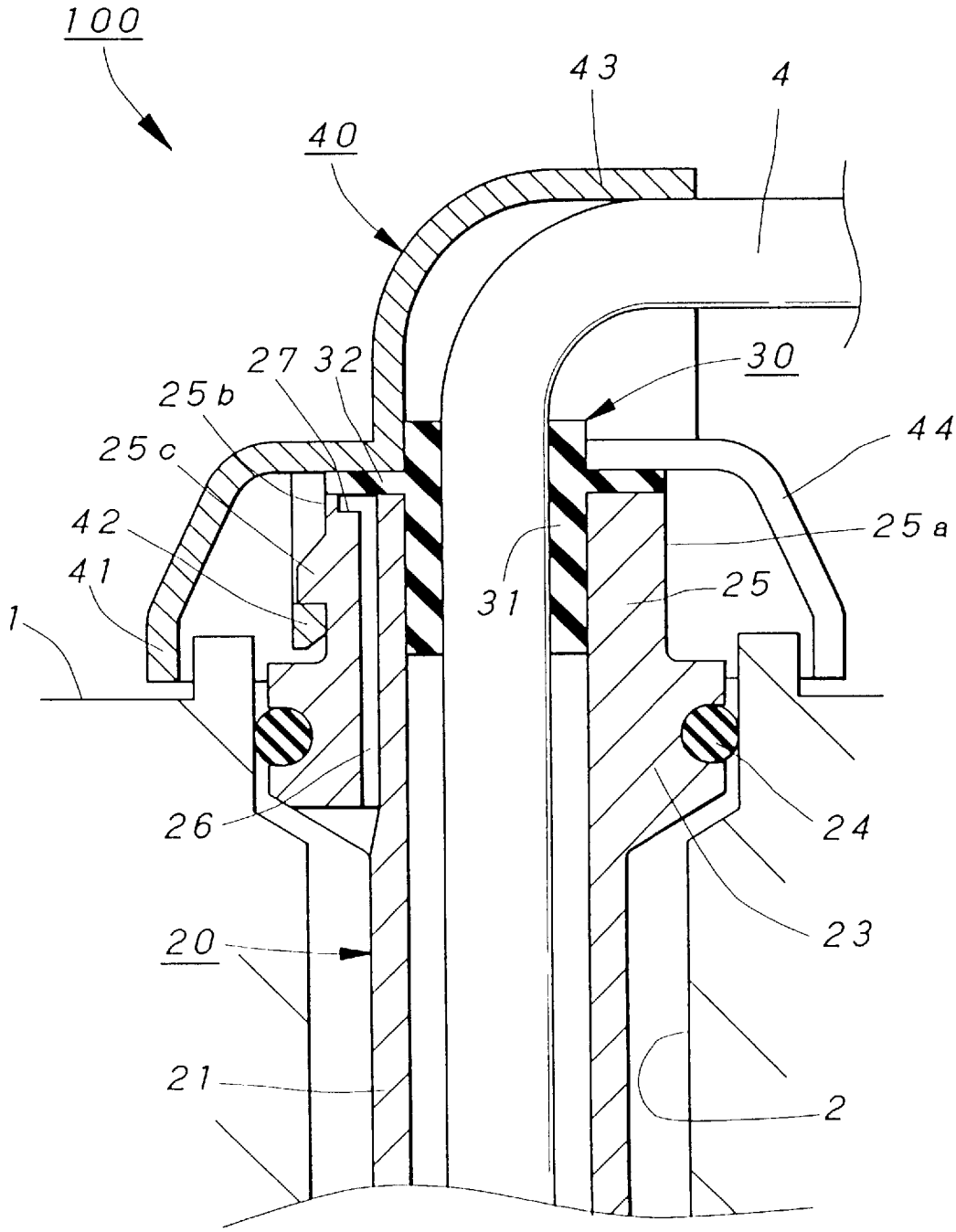
FIG. 2 is an enlarged cross-sectional view of an important portion in FIG. 1.
Figure 3:
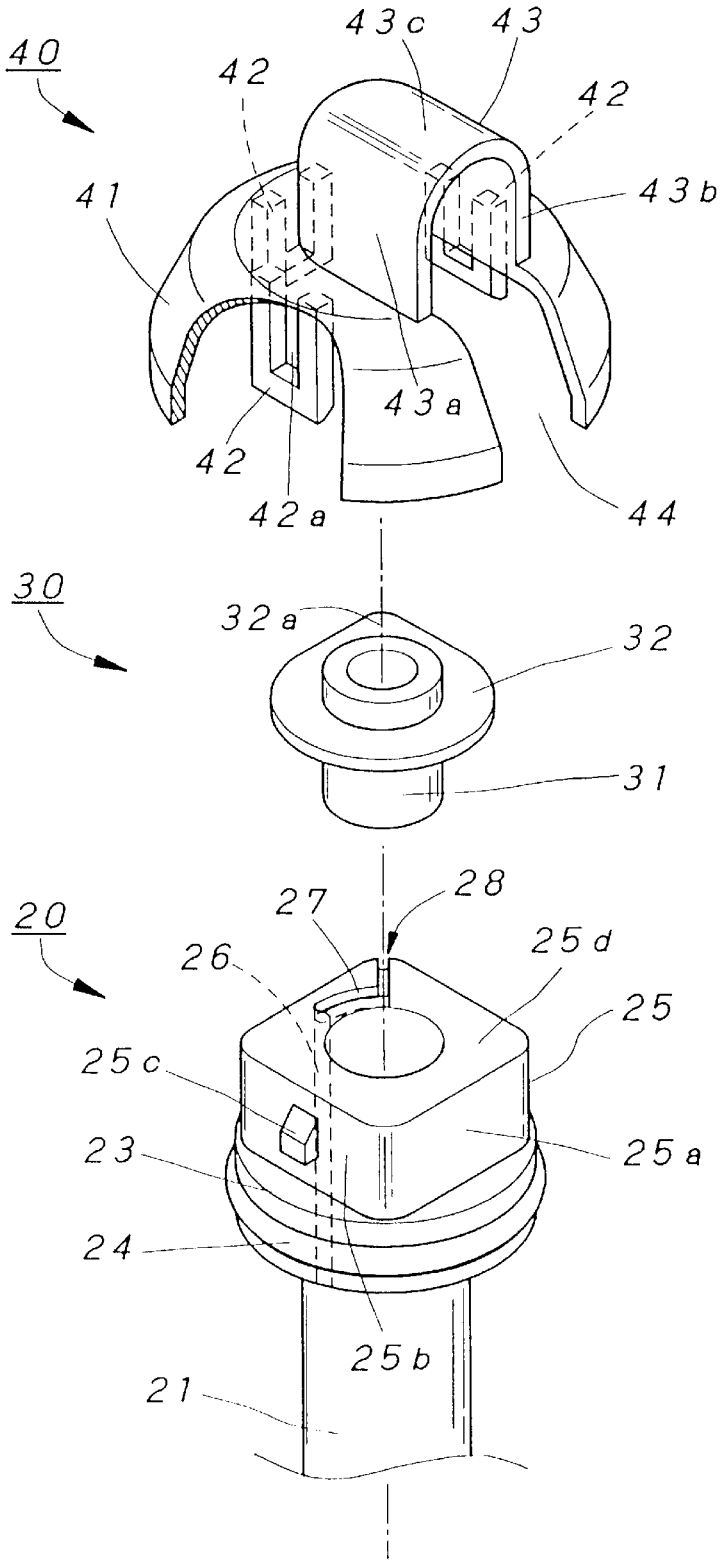
FIG. 3 is an exploded, perspective view showing main constituent parts in FIG. 1.

As shown in FIGS. 1 to 3, the plug cap 100 of this embodiment for an ignition plug includes the insulating pipe 20 inserted in an ignition plug-mounting hole 2 formed in an engine head 1, the insulating pipe 20 being molded of an insulative resin material. An end cap 22 of an insulative rubber material is fitted on a lower end of a cylindrical body portion 21 of the insulating pipe 20 , and this end cap 8 is fitted on an insulator portion of the ignition plug 3 so as to prevent the leakage of a high-voltage current.

A disk-shaped flange 23 is formed on an upper portion of the body portion 21, and an outer diameter of this flange 23 is slightly smaller than an inner diameter (i.e., bore) of the ignition plug-mounting hole 2. A peripheral groove is formed in an outer peripheral surface of the flange 23, and an O-ring (second seal member) 24 is fitted in this groove. As shown in FIG. 3, an upper end portion 25 of the body portion 21 has a square cross-section, and has four outer side walls, and as shown in FIG. 4, engagement projections 25*c* are formed respectively on three outer surfaces 25*b* except the outer surface 25*a* over which an ignition cable 4 extends.

As shown in FIG. 1, the vent hole 26, which communicates a space in the ignition plug-mounting hole 2 with the exterior of the engine, is formed in the insulating pipe 20 . As shown in FIG. 1, the vent hole 26 is open to an upper end surface 25*d* of the insulating pipe 20, and communicates with a vent groove 27 formed in the upper end surface 25*d*. The vent groove 27 is formed by two portions one of which extends circumferentially around the axis of the insulating pipe 20 whereas the other portion extends radially outwardly to a comer at which the outer surfaces 25*b* of the upper end portion 25 merge together.

As shown in FIG. 1, a front end portion of the ignition cable 4 for supplying a high-voltage current to the ignition plug 3 in the ignition plug-mounting hole 2 is inserted in the insulating pipe 20. A connection metal terminal 7 for connecting the ignition cable 4 to an end metal member of the ignition plug 3 is secured to the front end of the ignition cable 4.

A rubber plug (first seal member) 30 is fitted in the upper end portion 25 of the insulating pipe 20, and seals a gap between the ignition cable 4 and the inner surface of the insulating pipe 20 in a liquid-tight manner. This rubber plug 30 is molded of an insulative rubber material, and includes a cylindrical body portion 31 fitted in the upper end portion 25, and a flange 32 formed on an outer peripheral surface of this body portion 31, as shown in FIG. 3.

When the rubber plug 30 is fitted in the upper end portion 25 of the insulating pipe 20, with the flange 32 held in intimate contact with the upper end surface 25*d* of the insulating pipe 20, the flange 32 closes the upper open side of the vent groove 27. As a result, the vent groove 27 forms an extension portion of the vent hole 26 which is open to the outer surface 25*b* of the upper end portion of the insulation pipe 20.

The vent groove 27 is formed by the first portion, which extends circumferentially around the axis of the insulating pipe 20, and the second portion which extends radially outwardly to the corner, and therefore even if a droplet intrudes into an opening 28 of the vent groove 27, it will not easily reach the vent hole 26.

As shown in FIG. 1, a cap member 40, injection molded of an insulative resin material, is fixedly attached to the upper end portion 25 of the insulating pipe 20. As shown in FIG. 3, this cap member 40 includes a skirt-like cover portion 41 which covers those portions of the rubber plug 30 and O-ring 24 (first and second seal members) exposed to the exterior of the engine, three elastic retaining piece portions 42 which are formed on an inner surface of the cover portion 41, and retain the cap member 40 on the upper end portion 25 of the insulating pipe 20, an ignition cable-holding portion 43 which holds and curves the ignition cable 4, extending from the insulating pipe 20, to thereby regulate the angle of extension of the ignition cable 4 from the insulating pipe 20, and a notch portion 44 which receives the ignition cable 4 therein when attaching the cap member 40 to the insulating pipe 20.

The cover portion 41 not only covers the O-ring 24 and the rubber plug 30, but also entirely covers the open end of the ignition plug-mounting hole 2. The elastic retaining piece portions 42, when attached to the upper end portion 25 of the insulating pipe 20, are held respectively in intimate contact with the three outer surfaces 25*b* of the upper end portion 25, and also their engagement grooves 42*a* are engaged respectively with the retaining projections 25*c* formed respectively on the outer surfaces 25*b*, thereby fixing the cap member 40 to the insulating pipe 20.

The ignition cable-holding portion 43 is formed by a pair of left and right side walls 43*a* and 43*b* and a press wall 43*c* for pressing the ignition cable 4 from the upper side to curve the same. Part of the cover portion 41 is notched to communicate the inside of the cover portion 41 with the ignition cable-holding portion 43, thereby providing the notch portion 44 for receiving the ignition cable 4.

The assembling of the plug cap 100 of this embodiment for the ignition plug, having the above construction, will now be described.

Figure 8:
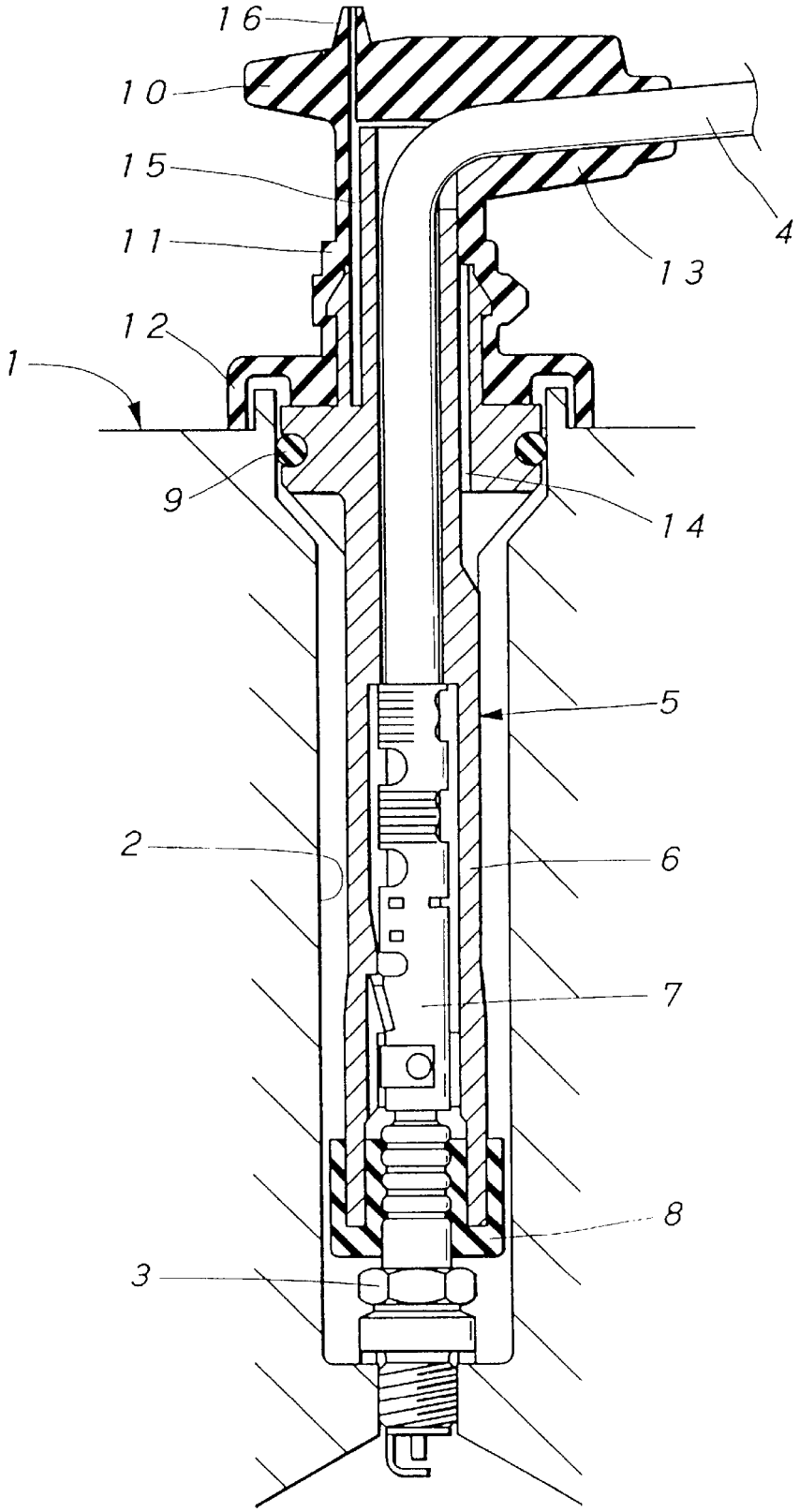
FIG. 8 PRIOR ART
FIG. 8 is a vertical cross-sectional view showing the whole of a conventional plug cap for an ignition plug.

First, the connection terminal 7, secured to the front end of the ignition cable 4, is inserted into the insulating pipe 20, and is fixed at a predetermined position. Then, the rubber plug 30, fitted on the ignition cable 4, is slid, and is fitted into the upper end portion 25 of the insulating pipe 20, with the flange 32 held in intimate contact with the upper end surface 25*d* of the insulating pipe 20. The rubber plug 30 is a small cylindrical member, and therefore the mounting of this rubber plug can be effected very easier as compared with the mounting of the ignition cable on the conventional rain cover and the mounting of the rain cover on the insulating pipe (see FIG. 8).

Then, the cap member 40 is at attached to the upper end portion 25 of the insulating pipe 20. Since the notch portion 44 is formed in the cap member 40, the cap member 40 can be easily attached to the ignition cable 4 and the insulating pipe 20.

The flange 32 of the rubber plug 30 is pressed by the cover portion 41 of the cap member 40 attached to the upper end portion 25 of the insulating pipe 20, and therefore is positively held in intimate contact with the upper end surface 25*d* of the insulating pipe 20.

The ignition cable 4 is held and curved by the ignition cable-holding portion 43 of the cap member 40, so that the angle of extension of the ignition cable 4 from the insulating pipe 20 is positively regulated. Then, when the O-ring is attached to the flange 23 of the insulating pipe 20, the assembling of the plug cap 100 for the ignition pug is completed.

When the cap member 40 is attached to the insulating pipe 20, the opening 28 of the extension portion 27 of the vent hole 26 is open to the inside of the cover portion 41 of the gap member 40. Therefore, water is prevented from being applied directly to the opening 28 of the vent hole 26.

As shown in FIGS. 4 and 5, a vertical wall 45 is formed on the inner surface of the cover portion 41 of the cap member 40 in opposed relation to the opening 28 of the vent hole 26, thereby making it more difficult for water to be applied to the opening 28 of the vent hole 26.

As shown in FIG. 6, a slanting surface 29 is formed on the inner surface of the opening 28 in such a manner that the opening 28 is increasing in cross-sectional area progressively toward its distal end, so that a droplet, intruded into the opening 28, can flow downward along this slanting surface 29 to be discharged to the exterior of the opening 28. Because of the inclination of the slanting surface 29, a droplet W, deposited on the slanting surface 29, is discharged to the exterior of the opening 28, so that the intrusion of the droplet W into the vent hole 26 can be positively prevented.

Even if a droplet W is deposited on the slanting surface 29, the ignition plug-mounting hole 2 can be ventilated through a gap above the droplet W as indicated by arrow B in FIG. 6. On the other hand, if the slanting surface 29 is not provided as shown in FIG. 7, a droplet W, intruded into the opening 28, is introduced into the vent hole 26 by a breathing action of the ignition plug-mounting hole 2.

Namely, in the plug cap 100 of this embodiment for the ignition plug, the gap between the ignition cable 4 and the inner surface of the insulating pipe 20 is sealed liquid-tight by the rubber plug 30, and also the gap between the inner surface of the ignition plug-mounting hole 2 and the outer surface of the insulating pipe 20 is sealed liquid-tight by the O-ring 24, and therefore the cost of the parts can be reduced as compared with the conventional construction using the rain cover, and besides the assembling operation is greatly improved, thereby markedly enhancing the efficiency of the operation.

The cover portion 41 of the cap member 40 covers the rubber plug 30 and the O-ring 24, and therefore water is prevented from being applied directly to the rubber plug 30 and the O-ring 24, and the intrusion of water into the ignition plug-mounting hole 2 can be more positively prevented.

The vent hole 26, which communicates the space in the ignition plug-mounting hole 2 with the exterior of the engine is formed in the insulating pipe 20 made of a resin, and therefore when mounting the insulating pipe into the ignition plug-mounting hole 2, the vent hole 26 will not be deformed or crushed, and the space in the ignition plug-mounting hole 2 can be positively communicated with the exterior.

Since the vent hole 26 is open to the inside of the cover portion 41 of the cap member 40, water will not be applied directly to the opening 28 of the vent hole 26, and the intrusion of water into the ignition plug-mounting hole 2 via the vent hole 26 is positively prevented.

The vent hole 26 has the extension portion 27 formed in the area of contact between the upper end surface 25*d* of the insulating pipe 20 and the flange 32 of the rubber plug 30, and therefore the vent hole 26 has an increased length, and even if water intrudes into the opening 28 of the vent hole 26, the water is prevented from easily reaching the inner portion of the vent hole 26.

The vertical wall 45, disposed in opposed relation to the opening 28 of the vent hole 26, is formed on the inner surface of the cover portion 41 of the cap member 40, and therefore water is more positively prevented from being applied directly to the opening 28 of the vent hole 26.

The slanting surface 29 is formed on the inner surface of the opening 28 in such a manner that the opening 28 is increasing in cross-sectional area progressively toward its distal end, so that the droplet W can flow downward along this slanting surface 29 to be discharged to the exterior of the opening 28. Therefore, even if the droplet W intrudes into the opening 28, this droplet W flows along the slanting surface 29, and is discharged to the exterior of the opening 28, and thus the droplet W will not intrude into the inner portion of the vent hole 26.

Even if the droplet W is deposited on the slanting surface 29, the ignition plug-mounting hole 2 can be ventilated through a gap above the droplet W, and therefore the droplet W will not be drawn into the vent hole 26 by a breathing action of the ignition plug-mounting hole 2.

The ignition cable 4 is held and curved by the ignition cable-holding portion 43 of the cap member 40 (made of a high-rigidity resin) fixed to the insulating pipe 20, and therefore the angle of extension of the ignition cable 4 from the insulating pipe 20 can be positively regulated. And besides, since the cap member 40 has the notch portion 44 for receiving the ignition cable 4, the cap member 40 can be easily attached to the ignition cable 4 and the insulating pipe 20.

The present invention is not limited to the above embodiment, and various modifications can be made. For example, although the vent groove, constituting the extension portion 27 of the vent hole 26, is formed in the upper end surface 25*d* of the insulating pipe 20, this vent groove may be formed in the flange 32 of the rubber plug (first seal member) 30.

As described above, the plug cap of the invention for the ignition plug comprises the insulating pipe inserted in the ignition plug-mounting hole, the ignition cable inserted in the insulating pipe so as to supply a high-voltage current to the ignition plug provided in the ignition plug-mounting hole, the first annular seal member which is fitted in the open end of the insulating pipe, and seals a gap between the ignition cable and the inner surface of the insulating pipe in a liquid-tight manner, the second annular seal member which is fitted on the insulating pipe, and seals a gap between the inner surface of the ignition plug-mounting hole and the outer surface of the insulating pipe in a liquid-tight manner, and the cap member of a resin fixed to the insulating pipe, the cap member including the cover portion which covers those portions of the first and second seal members exposed to the exterior of the engine, and the ignition cable-holding portion which holds and curves the ignition cable to thereby regulate the angle of extending of the ignition cable from the insulating pipe, and the vent hole, which communicates the space in the ignition plug-mounting hole with the exterior of the engine, is formed in the insulating pipe.

Therefore, the gap between the ignition cable and the inner surface of the insulating pipe is sealed liquid-tight by the first annular seal member, and also the gap between the inner surface of the ignition plug-mounting hole and the outer surface of the insulating pipe is sealed liquid-tight by the second annular seal member, and with this construction the cost of the parts can be made relatively low. Since the ignition cable is merely passed through the first seal member, the assembling efficiency can be enhanced.

Since the cover portion of the cap member covers those portions of the first and second seal members exposed to the exterior of the engine, water is prevented from being applied directly to the first and second seal members, and therefore the intrusion of water into the ignition plug-mounting hole can be positively prevented.

The vent hole, which communicates the space in the ignition plug-mounting hole with the exterior of the engine, is formed in the insulating pipe, and therefore the vent hole will not be deformed or crushed when mounting the insulating pipe into the ignition plug-mounting hole, and the space in the ignition plug-mounting hole can be positively communicated with the exterior.

The ignition cable is held and curved by the ignition cable-holding portion of the cap member (made of a high-rigidity resin) fixed to the insulating pipe, and therefore the angle of extension of the ignition cable from the insulating pipe can be positively regulated.

Since the vent hole is open to the inside of the cover portion of the cap member, water will not be applied directly to the opening of the vent hole, and the intrusion of water into the ignition plug-mounting hole via the vent hole is positively prevented.

The vent hole has the extension portion formed in the area of contact between the insulating pipe and the first seal member, and therefore even if water intrudes into the opening of the vent hole, the water is prevented from being introduced into the ignition plug-mounting hole via the vent hole.

The vertical wall for preventing the intrusion of water into the opening of the vent hole is formed on the inner surface of the cover portion of the cap member in opposed relation to this opening, and therefore water is more positively prevented from being applied directly to the opening of the vent hole.

The opening of the vent hole has the slanting surface such that the opening is increasing in cross-sectional area progressively toward its distal end, so that a droplet, intruded into the opening, can flow downward along this slanting surface to be discharged to the exterior of the opening. Therefore, even if a droplet intrudes into the opening, this droplet flows along the slanting surface, and is discharged to the exterior of the opening, and thus the droplet is positively prevented from intruding into the inner portion of the vent hole. Even if a droplet is deposited on the slanting surface, the ignition plug-mounting hole can be ventilated through a gap above this droplet, and therefore the droplet will not be drawn into the vent hole by a breathing action of the ignition plug-mounting hole.

Since the cap member has the notch portion for receiving the ignition cable, the cap member can be easily attached to the ignition cable and the insulating pipe, and the assembling efficiency is enhanced.

What is claimed is:

1. A plug cap for an ignition plug comprising:

an insulating pipe which is molded of an insulative resin material, and is inserted in an ignition plug-mounting hole formed in an engine head;

an ignition cable inserted in said insulating pipe so as to supply a high-voltage current to the ignition plug provided in said ignition plug-mounting hole;

a first annular seal member which is fitted in one open end of said insulating pipe remote from the ignition plug, and seals a gap between said ignition cable and an inner surface of said insulating pipe in a liquid-tight manner;

a second annular seal member which is fitted on said insulating pipe, and seals a gap between an inner surface of said ignition plug-mounting hole and an outer surface of said insulating pipe in a liquid-tight manner; and a cap member of a resin fixed to said insulating pipe, said cap member including a cover portion which covers those portions of said first and second seal members exposed to the exterior of the engine, and an ignition cable-holding portion which holds and curves said ignition cable to thereby regulate the angle of extension of said ignition cable from said insulating pipe; wherein a vent hole, which communicates a space in said ignition plug-mounting hole with the exterior of the engine, is formed in said insulating pipe.

2. A plug cap for an ignition plug according to claim 1, in which said vent hole is open to the inside of said cover portion of said cap member.

3. A plug cap for an ignition plug according to claim 1, in which said vent hole has an extension portion formed by a groove formed in that surface of said insulating pipe held in contact with said first seal member.

4. A plug cap for an ignition plug according to claim 1, in which a vertical wall for preventing water from being applied directly to an opening of said vent hole is formed on an inner surface of said cover portion of said cap member in opposed relation to said opening of said vent hole.

5. A plug cap for an ignition plug according to claim 4, in which said opening of said vent hole has such a slanting surface that said opening is increasing in cross-sectional area progressively toward its distal end, so that a droplet, intruded into said opening, can flow downward along said slanting surface to be discharged to the exterior of said opening.

6. A plug cap for an ignition plug according to claim 1, in which said cap member has a notch receiving said ignition cable therein.

* * * * *